United States Patent [19]

Gervais et al.

[11] Patent Number: 4,889,965

[45] Date of Patent: Dec. 26, 1989

[54] MICROWAVE DRYING OF THE PAPER INSULATION OF HIGH VOLTAGE ELECTROTECHNICAL EQUIPMENTS

[75] Inventors: Pierre Gervais, Brossard; Michel Duval, Montreal; Marcel Giroux, Repentigny, all of Canada

[73] Assignee: Hydro-Quebec, Montreal, Canada

[21] Appl. No.: 284,732

[22] Filed: Dec. 15, 1988

[51] Int. Cl.[4] ..... H05B 6/70

[52] U.S. Cl. ..... 219/10.55 M; 219/10.55 A; 34/1; 34/4

[58] Field of Search ..... 219/10.55 A, 10.55 F, 219/10.55 M, 10.55 R, 10.61 R, 10.81; 34/1, 4

[56] References Cited

U.S. PATENT DOCUMENTS

| | | | |
|---|---|---|---|
| 3,452,176 | 6/1969 | Levinson | 219/10.61 R |
| 3,590,202 | 6/1971 | Day et al. | 219/10.55 A |
| 3,887,722 | 6/1975 | Douglas et al. | 219/10.61 R |
| 4,259,560 | 3/1981 | Rhodes | 219/10.55 M |
| 4,392,039 | 7/1983 | Risman | 219/10.55 A |
| 4,771,156 | 9/1988 | Strattan et al. | 219/10.55 M |
| 4,780,585 | 10/1988 | Rochas et al. | 219/10.55 A |

*Primary Examiner*—Philip H. Leung

*Attorney, Agent, or Firm*—Foley & Lardner, Schwartz, Jeffery, Schwaab, Mack, Blumenthal & Evans

[57] ABSTRACT

The water and microwave permeable dielectric insulation in an electrotechnical high voltage equipment is dried by means of microwaves. The electrotechnical equipment has a central conductor on which the insulation is wrapped, and it is disposed within an electrically conducting hollow cylinder with its central conductor coaxial with the latter cylinder to form a coaxial, microwave transmission line. Microwaves are propagated through the coaxial transmission line to heat the water in the dielectric insulation, to transform it into water vapor, and to thereby dry the insulation. The microwave transmission line is air-tight and the water vapor is evacuated through a vacuum pump or cold trap.

18 Claims, 3 Drawing Sheets

MICROWAVE DRYING OF THE PAPER INSULATION OF HIGH VOLTAGE ELECTROTECHNICAL EQUIPMENTS

BACKGROUND OF THE INVENTION

1. Field of the Invention

The present invention relates to a method for drying the multi-layer paper insulation of high voltage electrotechnical equipments, such as transformer bushings, by means of microwaves. To carry out into practice the drying method, the present invention also relates to a microwave energy applicator as well as to a dryer apparatus including the latter applicator.

2. Brief Description of the Prior Art

In high voltage transformers, bushings traverse the metallic housing to permit connection with the winding terminals from the outside. Such a bushing comprises a through conductor wrapped in a multi-layer paper insulation. The paper insulation and a portion of the conductor are enclosed within a hermetically closed, cylindrical ceramic envelope filled with oil. The paper insulation is accordingly impregnated with this oil.

In use, humidity infiltrates within the bushing through fissures and joints in the ceramic envelope. Water therefore permeates the paper to destroy the dielectric insulation. The bushing must then be reconditioned.

To recondition the bushing, it is known to remove the through conductor with its paper insulation from the ceramic envelope, and to dispose these conductor and insulation in a conventional oven. The drawback of the conventional ovens is that the drying is very long, up to one month. Accordingly, such drying is so costly that the bushings are disposed of and replaced; replacement of the bushings being more advantageous than reconditioning them by drying of the paper insulation.

OBJECT OF THE INVENTION

The principal object of the present invention is therefore to provide for rapid drying of the paper insulation of bushings of the above type, at low cost, by means of microwaves.

SUMMARY OF THE INVENTION

More specifically, in accordance with the present invention, there is provided a method of drying water-permeable and microwave-permeable dielectric insulation in an electrotechnical equipment including a through, inner and elongated electric conductor wrapped in the said insulation infiltrated with water, comprising the steps of:

- mounting the electrotechnical equipment within a hollow tubular element made of electrically conducting material, with the electric conductor coaxial with the hollow tubular element to thereby form a coaxial, microwave transmission line;
- propagating microwaves through the coaxial transmission line to heat the water infiltrated within the dielectric insulation and transform it into water vapor; and
- evacuating the water vapor outside of the said coaxial transmission line.

Transformation of the water into water vapor and evacuation of this vapor outside of the transmission line cause drying of the dielectric insulation.

In accordance with the present invention, there is also provided a microwave energy applicator for applying microwave energy to water infiltrated within water-permeable and microwave-permeable dielectric insulation of an electrotechnical equipment including a through inner and elongated electric conductor wrapped in the insulation, comprising: .

- a hollow tubular element made of electrically conducting material;
- means for mounting the electrotechnical equipment within the with the electric conductor coaxial with the tubular element in order to form a coaxial, microwave transmission line capable of propagating microwaves through the dielectric insulation to thereby apply microwave energy to the infiltrated water.

The present invention further relates to an apparatus for drying water-permeable and microwave-permeable dielectric insulation in an electrotechnical equipment including a through, inner and elongated electric conductor wrapped in the insulation infiltrated with water, comprising:

- a hollow tubular element made of electrically conducting material;
- means for mounting the electrotechnical equipment within the tubular element with the electric conductor coaxial with the tubular element whereby the electric conductor and tubular element form a coaxial, microwave transmission line;
- means for propagating microwaves through the coaxial transmission line and accordingly through the dielectric insulation to heat the water infiltrated within the dielectric insulation and transform it into water vapor; and
- means for evacuating the water vapor outside of the coaxial, microwave transmission line.

Again, transformation of the water into water vapor and evacuation of the vapor outside of the transmission line cause drying of the dielectric insulation.

Microwave drying of the insulation of an electrotechnical equipment of the above type is fast and low cost, whereby it becomes more advantageous to recondition the electrotechnical equipment through drying of its dielectric insulation, than replacing such an equipment.

In order to improve the efficiency in insulation drying, the coaxial, microwave transmission line may be closed at both ends thereof by means of two microwave windows, to thereby form an air-tight enclosure, and the water vapor inside of the transmission line may be evacuated by means of a vacuum pump or a cold trap.

The objects, advantages and other features of the present invention will become more apparent upon reading of the following non restrictive description of preferred embodiments thereof, given in conjunction with the accompanying drawings.

BRIEF DESCRIPTION OF THE DRAWINGS

In the attached drawings

FIG. 2(*b*) is a transversal, cross-sectional view of the microwave energy applicator of FIG. 2(*a*) taken along axis A13 A of the latter Figure;

FIG. 2(*c*) is another transversal, cross-sectional view of the microwave energy applicator of FIG. 2(*a*) taken along axis B—B of the latter Figure.

DETAILED DESCRIPTION OF THE PREFERRED EMBODIMENTS

Figure 1:
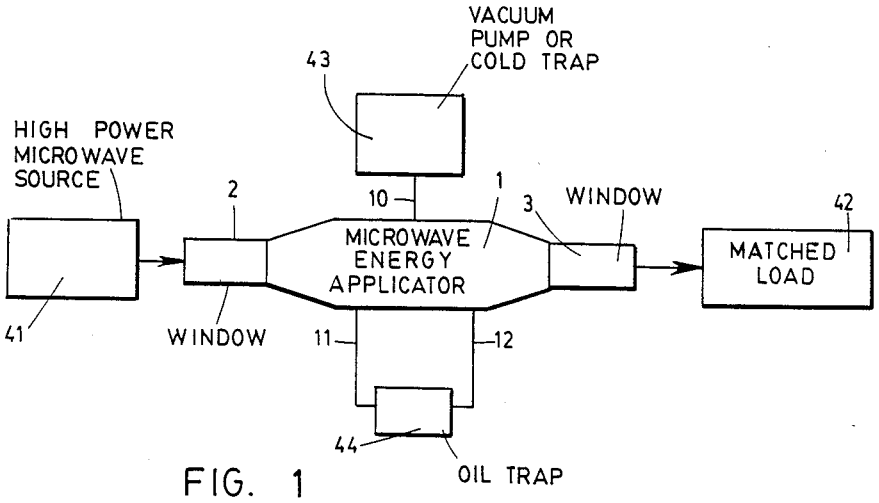
FIG. 1 represents, under the form of block diagram, a first embodiment of paper insulation drying apparatus according to the invention, including a microwave energy applicator.

In the different Figures of the drawings, the corresponding elements are identified by the same reference numerals.

Figure 3:
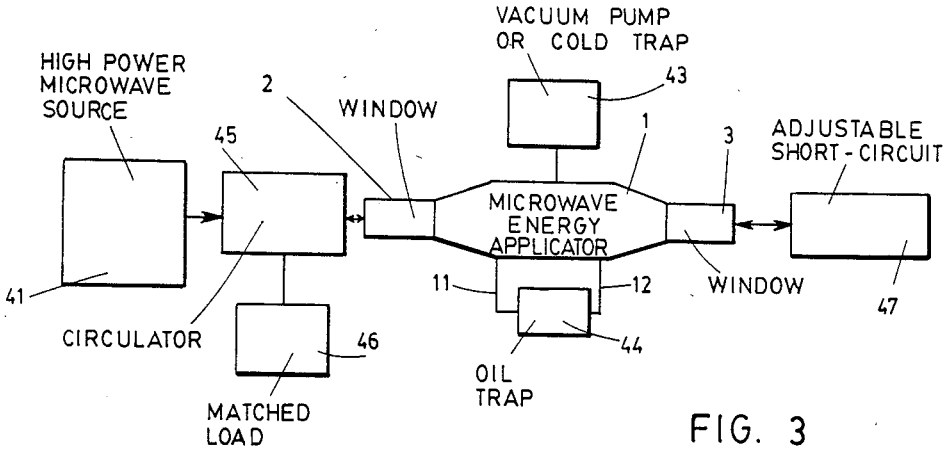
FIG. 3, which is disposed on the same sheet of formal drawings as FIG. 1, represents under the form of block diagram a second embodiment of paper insulation drying apparatus in accordance with the present invention.

The two paper insulation drying apparatuses illustrated in FIGS. 1 and 3 each comprise a microwave energy applicator 1. The applicator 1 has a first end to which is connected a first microwave window 2, and a second end to which is connected a second microwave window 3.

Figure 2A:
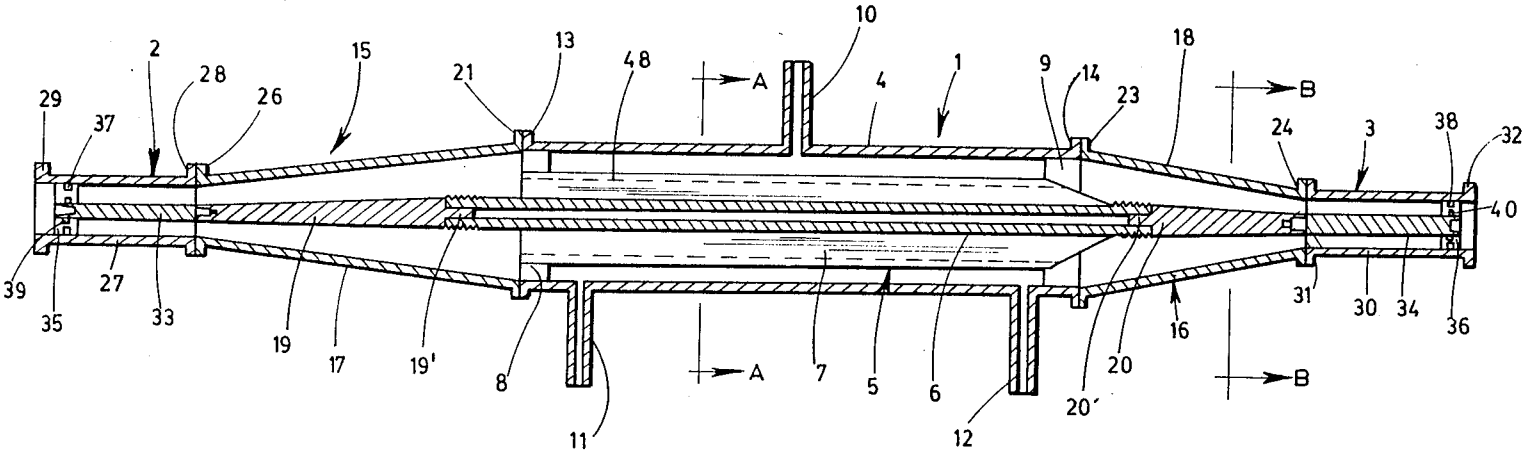
FIG. 2(*a*) is a longitudinal, cross-sectional view of the microwave energy applicator of the drying apparatus of FIG. 1, with two microwave windows connected to the respective ends thereof, which cross-sectional view is taken along axis, C—C of FIG. 2(*b*)
Figure 2B:
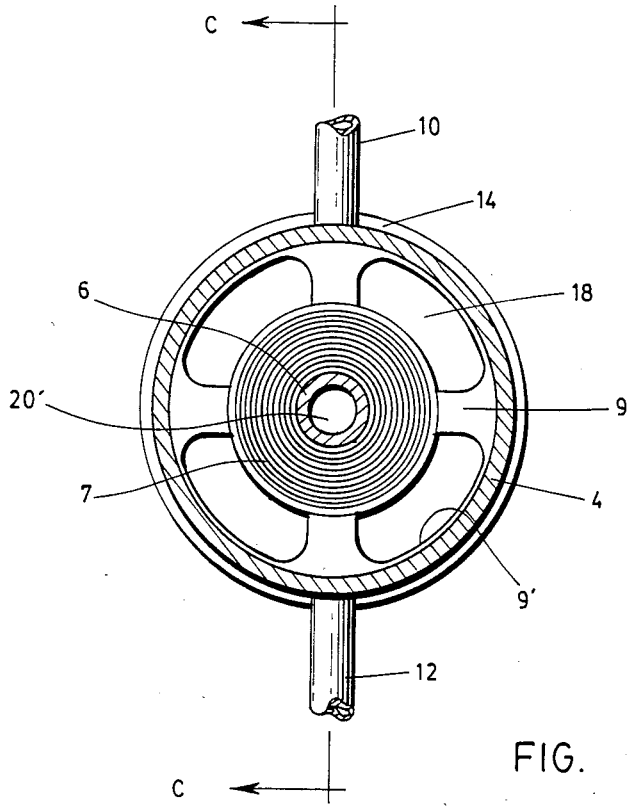
Figure 2C:
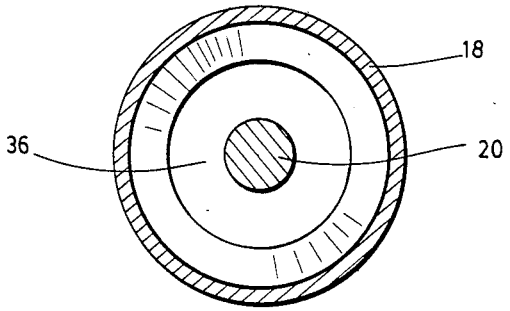

The physical structure of the applicator 1 and windows 2 and 3 is shown in detail in FIGS. 2(*a*), 2(*b*) and 2(*c*).

More specifically, the applicator 1 first comprises a metallic, electrically conducting tubular element 4, namely a cylinder circular in cross section in which is mounted the bushing of which the insulation is to be dried.

In the illustrated example, the bushing, identified by the reference numeral 5, is one designed for use with a high voltage transformer. Such a bushing 5 comprises a metallic, through conductor 6, namely an elongated, hollow tube externally threaded at both ends thereof for electric connection purposes. The conductor 6 is straight, it is cylindrical, that is of circular cross section, and it is also insulated by means of a dielectric, multi-layer paper insulation 7 wrapped thereon. As can be seen in FIG. 2(*a*), one end of the multi-layer paper insulation 7 is perpendicular to the collector 6 while the other end thereof is taper. Of course, the bushing 5 has been withdrawn from its ceramic envelope and, as mentioned hereinabove, its paper insulation is impregnated with oil but also contains infiltrated water.

It is important that the cylinder 4 and conductor 6 be coaxial as accurately as possible. For that purpose, the bushing 5 is held in position within the cylinder 4 by means of two end, annular support members 8 and 9, interposed between the paper insulation 7 and the inner surface of the cylinder 4. The two support members 8 and 9 are made of dielectric material transparent to microwaves, and are structured to define passages such as 9′ from one side to the other side thereof when the support member 8 and 9 are inserted between the cylinder 4 and the bushing paper insulation 7.

Accordingly, the metallic cylinder 4 and conductor 6 form a coaxial, microwave transmission line capable of propagating microwaves. More specifically, the conductor 6 constitutes the inner conductor of the line, the cylinder 4 the outer conductor of such a line, and the paper insulation 7 acts as dielectric in the coaxial transmission line.

The cylinder 4 comprises a vertical, upper outlet conduit 10, two vertical, lower outlet conduits 11 and 12, as well as two end, flange connectors 13 and 14.

The microwave energy applicator 1 further comprises two coaxial-to-coaxial transitions 15 and 16 at the respective ends thereof. Each transition 15, 16 includes a frusto-conical waveguide section 17, 18 (outer conductor) circular in cross section and a taper inner conductor 19, 20 coaxial with the waveguide section 17, 18 and also circular in cross section.

The waveguide section 17 comprises a flange connector 21 at the proximal end thereof, and another standard flange connector 26 at the distal end thereof. Similarly, the waveguide section 18 comprises a flange connector 23 at its proximal end, as well as another standard flange connector 24 at the distal end thereof. The flange connector 21 is attached to the flange connector 13 while producing an air-tight joint between these connectors 13 and 21. An air-tight joint is also produced between the interconnected flange connectors 14 and 23 of the cylinder 4 and waveguide section 18. Production of such air-tight joints is within the usual knowledge of one skilled in the art and accordingly will not be further elaborated.

As illustrated in FIG. 2(*a*), the inner conductor 19 is formed with a pin 19′ at the proximal end thereof, which pin 19′ is forced into the corresponding end of the hollow tube 6. Similarly, the inner conductor 20 is formed with a pin 20′ at the proximal end thereof, which pin 20′ is also forced into the other end of the hollow tube 6. The inner conductors 19 and 20 are thereby mounted on the hollow, electrically conducting tube 6.

The microwave window 2 comprises a standard 50 Ω waveguide section 27, circular in cross section and comprising a proximal, standard flange connector 28 fixed to the flange connector 26 while producing an air-tight joint between the connectors 26 and 28. The waveguide section 27 further comprises a distal standard flange connector 29. Similarly, the microwave window 3 comprises a section 30 of standard 50 Ω circular waveguide having a proximal, standard connector flange 31 attached to the flange connector 24. Again, an air-tight joint is produced between the flange connectors 24 and 31. The waveguide section 30 of course comprises a distal standard flange connector 32.

Each microwave window 2, 3 also includes an inner, central conductor 33, 34 coaxial with the waveguide section 27, 30 and of constant circular cross section. Each conductor 33, 34 has a hollow proximal end forced into a coaxial hole bored through the distal end of the inner taper conductors 19, 20, whereby the conductor 33, 34 is attached to the conductor 19, 20.

Each window 2, 3 further comprises an annular stopper 35, 36 made of a dielectric material transparent to microwaves. Each stopper 35, 36 can be longitudinally slid into the waveguide section 27, 30 and accordingly around the inner conductor 33, 34. A first O-ring 37, 38 seals the joint between the stopper 35, 36 and the inner surface of the waveguide section 27, 30 while a second O-ring 39, 40 seals the joint between the stopper 35, 36 and the inner conductor 33, 34. The stopper 35, 36 maintains the conductor 33, 34 coaxial with the waveguide section 27, 30, and its position in the latter waveguide section is so adjusted as to obtain an optimum reflection coefficient, that is as low as possible.

As can be appreciated, the window 2, the transition 15, the cylinder 4 and conductor 6, the transition 16 and the window 3 constitute a global, coaxial microwave transmission line capable of propagating microwaves, whose outer conductor is formed by the coaxial waveguide sections 27 and 17, cylinder 4, and waveguide sections 18 and 30, and whose inner conductor is formed by the conductors 33, 19, 6, 20 and 34 aligned along a common axis.

The function of the transition 15 is to match the impedance of the window 2 with the impedance of the coaxial transmission line formed by the cylinder 4 and conductor 6. For that purpose, the waveguide section 17 gradually increases in inner diameter from the inner diameter of the waveguide section 27 to the inner diameter of the cylinder 4, while the taper, inner conductor 19 gradually increases in outer diameter from the outer diameter of the conductor 33 to that of the conductor 6.

Similarly, the transition 16 matches the impedance of the coaxial transmission line formed by the cylinder 4 and conductor 6 with that of the microwave window 3 . For that purpose, the waveguide section 18 gradually reduces in inner diameter from the inner diameter of the cylinder 4 to the inner diameter of the waveguide section 30, while the taper, inner conductor 20 also gradually reduces in outer diameter from the outer diameter of the conductor 6 to that of the conductor 34.

Impedance matching by the transitions 15 and 16 prevent production of a standing wave within the global, coaxial microwave transmission line including the window 2, transition 15, cylinder 4 and conductor 6, transition 16 and window 3, due to reflections caused by lack of such impedance matching. Such a standing wave comprises maximums and minimums and would result into a non uniform water heating throughout the paper insulation.

As can be appreciated, the windows 2 and 3, the transitions 15 and 16, and the cylinder 4 and conductor also define an air-tight, annular enclosure.

Referring back to FIG. 1 of the drawings, the paper insulation drying apparatus comprises a high power microwave source 41, advantageously constituted by a magnetron generator. Microwaves from the source 41 are transmitted to the window 2 through a conventional waveguide-to-coaxial transition (not shown) connected to the standard flange connector 29 of the waveguide section 27 (FIG. 2(*a*)). The microwaves from the source 41 propagate in the window 2, the applicator 1, and the window 3 and are transmitted to a matched load 42 through a conventional coaxial-to-waveguide transition (not shown) attached to the standard connector 32 (FIG. 2(*a*)). As the load 42 is matched, no reflection occurs as this load absorbs all of the energy of the microwaves propagated through the windows 2 and 3 and the applicator 1 and not absorbed by the water itself, whereby no standing wave is produced within the applicator 1 whereby uniform water heating is effected throughout the paper insulation 7 due to uniform distribution of the electric field in the transmission line.

In FIG. 3, the high power microwave source 41 transmits microwaves to the window 2 through a circulator 45 connected to the window 2 through a waveguide-to-coaxial transition (not shown) which is attached to the standard flange connector 29 (FIG. 2*a*)). The microwaves propagate through the window 2, the applicator 1 and the window 3 and are transmitted to an adjustable short circuit 47 connected to the flange connector 32 (FIG. 2*a*)) of the waveguide section 30 through a conventional coaxial-to-waveguide transition (not shown). The microwaves reaching the short circuit 47 are reflected and transmitted to a matched load 46 through the window 3, the applicator 1, the window 2 and the circulator 45. A standing wave with maximums and minimums is accordingly produced within the coaxial line formed by the cylinder 4 and conductor 6. The short circuit 47 is moved to displace the minimums and maximums of the standing wave in the applicator 1 in order to obtain uniform water heating throughout the paper insulation 7. Of course, the microwave energy reaching the matched load 46 is absorbed by the latter, substantially without microwave reflection.

The microwaves propagated through the coaxial transmission line formed by the cylinder 4 and conductor 6 oscillate the molecules of water in the paper insulation 7. The water is thereby heated and transformed into water vapor. In both the embodiments of FIGS. 1 and 3, a vacuum pump 43 sucks the so produced water vapor through the upper, outlet conduit 10 of (FIG. 2*a*) in order to improve and accelerate the drying process by forcing evacuation of the water vapor from the air-tight enclosure. It is accordingly important that the O-rings 37, 38, 39 and 40 and the pairs of flange connectors 26, 28; 13, 21; 14, 23; and 24, 31 produce air-tight joints to form the above described air-tight enclosure. The oil impregnated in the paper insulation 7 is also heated by both the microwaves and the water vapor, whereby its fluidity increases and it flows by gravity toward an oil trap 44 through the two lower, outlet conduits 11 and 12, and that in both the embodiments of FIGS. 1 and 3.

The passages such as 9' through the support members 8 and 9 provide for passage of water vapor and oil from the transitions 15 and 16 toward the respective outlet conduits 10, 11 and 12.

The vacuum pump 43 can be replaced by a cold trap, using liquid nitrogen ($N_2$) or carbon dioxide ($CO_2$), such a cold trap being of course well known in the art.

Both the embodiments of FIGS. 1 and 3 dry rapidly by microwaves the paper insulation 7, the time of drying being counted in hours instead of in days as in the case of drying in conventional ovens. Drying of the insulation 7 becomes economical, and low cost reconditioning of high voltage transformer bushings is therefore enabled.

As the microwave transmission line formed by the cylinder 4 and the conductor 6 is coaxial, dominant TEM mode for the microwave propagation is particularly efficient in uniformly drying the paper insulation as the microwaves are uniformly distributed over the annular space between the conductor 6 and cylinder 4, whereby water is uniformly heated over the said insulation 7.

The frequency of the microwaves is important in that the microwave wavelength must be close to the inner diameter of the cylinder 4 in order to obtain propagation in dominant TEM mode.

Often, a cylindrical, metallic shielding such as 48 shown in dashed lines (in FIG. 2*a*) is provided in the paper insulation 7. In this case, two parallel, coaxial transmission lines are formed; the first one is constituted by the conductor 6 and the shielding 48 while the second one consists of the shielding 48 and cylinder 4. The present invention can still be used to dry the multi-layer paper insulation, but appropriate impedance matching must be carried out using the transitions 15 and 16 and eventually tuning screws.

The present invention can be used for drying the multi-layer paper insulation of high voltage transformer bushings or of any other high voltage electrotechnical equipments provided that they comprise an inner, central conductor on which the multi-layer paper insulation is wrapped, and that such a conductor can be used as the inner conductor of a coaxial, microwave transmission line. The central conductor of the electrotechnical equipment does not need to be straight. Indeed, it can be somewhat arcuate provided that the tubular element 4 is similarly arcuate to form the required coaxial, microwave transmission line. The central conductor of the equipment may also present discontinuities, provided that appropriate impedance matching is carried out.

The present invention can also be used with dielectric insulation other than paper, provided that such insulation is water and microwave permeable.

Although the present invention has been described hereinabove by way of preferred embodiments thereof, such preferred embodiments can of course be modified at will, within the scope of the appended claims, without changing or altering the nature and scope of the present invention.

What is claimed is:

1. A method of drying water-permeable and microwave-permeable dielectric insulation in an electrotechnical equipment including a through, inner and elongated electric conductor wrapped in the said insulation infiltrated with water, comprising the steps of:

mounting the said equipment within a hollow tubular element made of electrically conducting material, with the electric conductor coaxial with the said tubular element to thereby form a coaxial, microwave transmission line;

propagating microwaves through the coaxial transmission line to heat the water infiltrated within the dielectric insulation and transform it into water vapor; and evacuating the water vapor outside of the said coaxial transmission line;

transformation of the water into water vapor and evacuation of the said vapor outside of the transmission line causing drying of the dielectric insulation.

2. A dielectric insulation drying method according to claim 1, wherein said water vapor evacuating step comprises the step of sucking the water vapor outside of the coaxial, microwave transmission line.

3. A dielectric insulation drying method according to claim 1, wherein said microwave propagating step comprises the steps of:

producing within the said coaxial transmission line a standing wave with maximums and minimums; and moving said maximums and minimums of the standing wave along the transmission line to produce uniform heating of the water throughout the said dielectric insulation.

4. A dielectric insulation drying method according to claim 1, wherein the dielectric insulation is impregnated with oil, the said drying method further comprising the step of evacuating oil from the said dielectric insulation outside of the said transmission line.

5. A microwave energy applicator for applying microwave energy to water infiltrated within water-permeable and microwave-permeable dielectric insulation of an electrotechnical equipment including a through, inner and elongated electric conductor wrapped in the said insulation, comprising:

a hollow tubular element made of electrically conducting material;

means for mounting the electrotechnical equipment within the tubular element with the said electric conductor coaxial with the tubular element in order to form a coaxial, microwave transmission line capable of propagating microwaves through the dielectric insulation to thereby apply microwave energy to the infiltrated water; and means for propagating microwaves through the coaxial transmission line and accordingly through the dielectric insulation to heat said water infiltrated within the dielectric insulation and transform it into water vapor.

6. A microwave energy applicator according to claim 5, in which the said equipment mounting means comprises annular support members inserted between the said tubular element and the electrotechnical equipment, said support members being made of a dielectric material transparent to microwaves and being so shaped as to define passages from one side to the other side thereof when inserted between the said equipment and tubular element.

7. A microwave energy applicator according to claim 5, wherein the coaxial transmission line formed by the elongated conductor and the tubular element has first and second ends, said microwave energy applicator further comprising:

a first coaxial-to-coaxial transition with a first end, and with a second end connected to the first end of the coaxial, microwave transmission line; and a second coaxial-to-coaxial transition with a first end, and with a second end connected to the second end of the said coaxial, microwave transmission line.

8. A microwave energy applicator according to claim 7, in which the first end of the first transition is closed by means of a first microwave window, while the first end of the second transition is closed by means of a second microwave window, the coaxial, microwave transmission line including the said elongated electric conductor and hollow tubular element, the first and second transitions, and the first and second windows defining an air-tight enclosure.

9. A microwave energy applicator according to claim 8, wherein:

the tubular element is circular in cross section and has an inner diameter;

the electric conductor of the said electrotechnical equipment is also circular in cross section and has an outer diameter;

each of said windows comprises (a) a section of circular waveguide having an inner diameter, (b) an elongated, central conductor circular in cross section, coaxial with said circular waveguide section and having an outer diameter, and (c) an annular stopper slidable in the section of circular waveguide and on the central conductor of the window, the stopper being made of a dielectric material transparent to microwaves; and each of said transitions comprises (a) a frustoconical waveguide section circular in cross section, interposed between the waveguide section of the corresponding window and the hollow tubular element, and having an inner diameter gradually varying from the inner diameter of the tubular element to the inner diameter of said circular waveguide section of the window, and (b) an inner, taper electric conductor circular in cross section, interposed between the electric conductor of the electrotechnical equipment and the central conductor of the corresponding window, and having an outer diameter gradually varying from the outer diameter of the conductor of the electrotechnical equipment to the outer diameter of the central conductor of the microwave window.

10. A microwave energy applicator according to claim 9, wherein each of said microwave windows comprises a first O-ring forming a sealing joint between its stopper and its circular waveguide section, and a second O-ring forming a sealing joint between its annular stopper and its central conductor.

11. A microwave energy applicator according to claim 5, wherein the said coaxial transmission line comprises first and second ends closed by means of first and second microwave windows, respectively.

12. A microwave energy applicator according to claim 11, in which the said tubular element comprises an outlet conduit for evacuating water vapor outside of the coaxial, microwave transmission line, said infiltrated water being transformed into said water vapor upon application of microwave energy thereto.

13. A microwave energy applicator according to claim 5, in which the said dielectric insulation is impregnated with oil, and in which the tubular element comprises at least one bottom outlet conduit through which oil of increased fluidity from the insulation is evacuated by gravity toward an oil trap.

14. An apparatus for drying water-permeable and microwave-permeable dielectric insulation in an electrotechnical equipment including a through, inner and elongated electric conductor wrapped in the said insulation infiltrated with water, comprising:

a hollow tubular element made of electrically conducting material;

means for mounting the electrotechnical equipment within the tubular element with the said electric conductor coaxial with the tubular element whereby the said electric conductor and tubular element form a coaxial, microwave transmission line;

means for propagating microwaves through the coaxial transmission line and accordingly through the dielectric insulation to heat the said water infiltrated within the dielectric insulation and transform it into water vapor; and means for evacuating the water vapor outside of the said coaxial, microwave transmission line;

transformation of the water into water vapor and evacuation of the said vapor outside of the transmission line causing drying of the dielectric insulation.

15. A dielectric insulation drying apparatus according to claim 14, wherein the microwave propagating means comprises:

a high power microwave source generating microwaves and connected to a first end of the coaxial, microwave transmission line; and a matched load connected to a second end of the said coaxial line;

whereby, in operation, microwaves are transmitted from the high power microwave source to the matched load through the coaxial transmission line, the energy of the microwaves which is not absorbed by the water infiltrated within the dielectric insulation being absorbed by the matched load to prevent reflection of microwaves at the latter load and production of a standing wave within the coaxial, microwave transmission line.

16. A dielectric insulation drying apparatus according to claim 14, wherein said means for propagating microwaves through the said coaxial transmission line comprises:

a high power microwave source for generating microwaves;

a microwave circulator interposed between a first end of the said transmission line and the microwave source;

a waveguide short circuit connected to a second end of the coaxial, microwave transmission line; and a matched load connected to the circulator;

whereby, in operation microwaves are transmitted to the short circuit from the high power microwave source through the circulator and coaxial transmission line, which microwaves are reflected by the waveguide short circuit and transmitted to the matched load through the coaxial transmission line and the circulator, the energy of the microwaves reaching the matched load being absorbed by said matched load, and a standing wave with maximums and minimums being produced inside of the coaxial, microwave transmission line as microwaves are reflected by the short circuit

17. A dielectric insulation drying apparatus according to claim 16, wherein said waveguide short circuit is an adjustable short circuit, which is moved to change the position of the maximums and minimums of the standing wave in the coaxial transmission line to provide for uniform heating of the infiltrated water throughout the said dielectric insulation.

18. A dielectric insulation drying apparatus according to claim 14, wherein said water vapor evacuating means comprises means for sucking the said water vapor.

* * * * *